US011096428B1

(12) United States Patent
Bounkhong

(10) Patent No.: US 11,096,428 B1
(45) Date of Patent: Aug. 24, 2021

(54) UNDERGARMENT SUPPORT SYSTEM AND METHOD OF USE

(71) Applicant: Khanthamala Bounkhong, Garland, TX (US)

(72) Inventor: Khanthamala Bounkhong, Garland, TX (US)

( * ) Notice: Subject to any disclaimer, the term of this patent is extended or adjusted under 35 U.S.C. 154(b) by 63 days.

(21) Appl. No.: 16/525,662

(22) Filed: Jul. 30, 2019

Related U.S. Application Data

(63) Continuation-in-part of application No. 15/248,278, filed on Aug. 26, 2016, now Pat. No. 10,368,599.

(60) Provisional application No. 62/209,942, filed on Aug. 26, 2015.

(51) Int. Cl.

| | |
|---|---|
| ***A41C 3/08*** | (2006.01) |
| ***A41F 17/00*** | (2006.01) |
| ***A41F 15/00*** | (2006.01) |
| ***A41F 9/00*** | (2006.01) |

(52) U.S. Cl.
CPC ..... *A41C 3/08* (2013.01); *A41F 9/002* (2013.01); *A41F 15/002* (2013.01); *A41F 17/00* (2013.01)

(58) Field of Classification Search
CPC ..... A41C 3/08; A41F 9/002; A41F 11/14
USPC ..... 2/109, 110, 300, 305, 310; 450/14–17
See application file for complete search history.

(56) References Cited

U.S. PATENT DOCUMENTS

| | | | | |
|---|---|---|---|---|
| 3,982,547 | A * | 9/1976 | Walker | A41C 3/00 450/28 |
| 10,368,599 | B1 * | 8/2019 | Bounkhong | A41F 17/00 |
| 2012/0090078 | A1 * | 4/2012 | von Olnhausen | A41C 3/08 2/326 |

* cited by examiner

*Primary Examiner* — Katherine M Moran
(74) *Attorney, Agent, or Firm* — Leavitt Eldredge Law Firm

(57) ABSTRACT

A suspender system and method of use includes an elongated belt strap that removably engages around the midsection of the user; a first connector secured to a top edge of the elongated belt strap and engaged with a first garment of clothing worn by the user; a second connector secured to a bottom edge of the elongated belt strap and engaged with a second garment of clothing worn by the user.

6 Claims, 7 Drawing Sheets

UNDERGARMENT SUPPORT SYSTEM AND METHOD OF USE

BACKGROUND

1. Field of the Invention

The present invention relates generally to clothing accessory systems, and more specifically, to an undergarment support system for women.

2. Description of Related Art

Undergarment systems are well known in the art and are effective means to provide user support. For example, FIG. 1 depicts a rear view of a common undergarment system 101 having a bra 102 including two straps 103 in communication with a band 104. During use, the bra 102 provides support to the user's breasts by being secured around the user's midsection via the band 104 and straps 103.

One of the problems commonly associated with system 101 is its uncomfortable fit. For example, the band of system 101 may place uncomfortable pressure along areas of the user's midsection and shoulders.

Accordingly, although great strides have been made in the area of undergarment systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
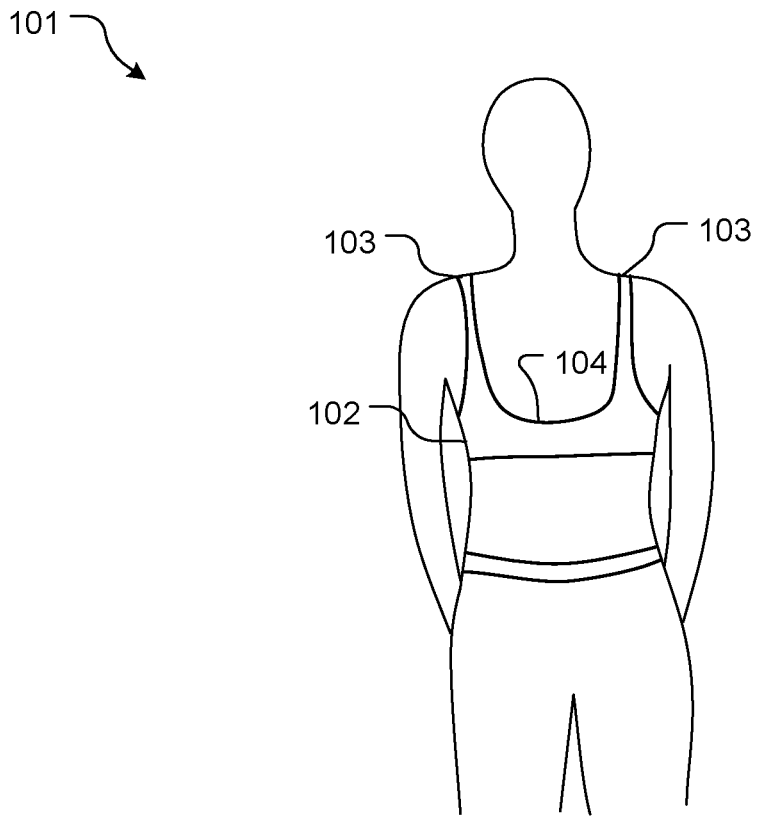
FIG. 1 (Prior Art)
FIG. 1 is a rear view of a common undergarment system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional undergarment systems. Specifically, the present invention reduces pressure along the user's midsection and shoulders. In addition, the present invention provides undergarment support and structure. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
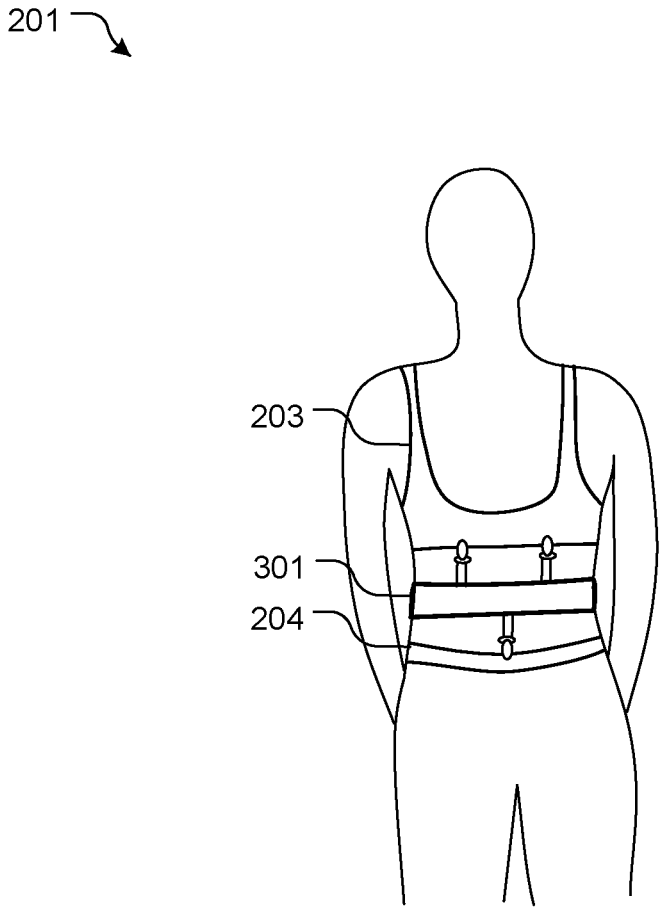
FIG. 2 is a rear view of an undergarment support system in accordance with a preferred embodiment of the present application.

Referring now to the drawings wherein like reference characters identify corresponding or similar elements throughout the several views, FIG. 2 depicts a rear view of an undergarment support system in accordance with a preferred embodiment of the present application. It will be appreciated that system 201 overcomes one or more of the above-listed problems commonly associated with conventional undergarment systems.

Figure 3:
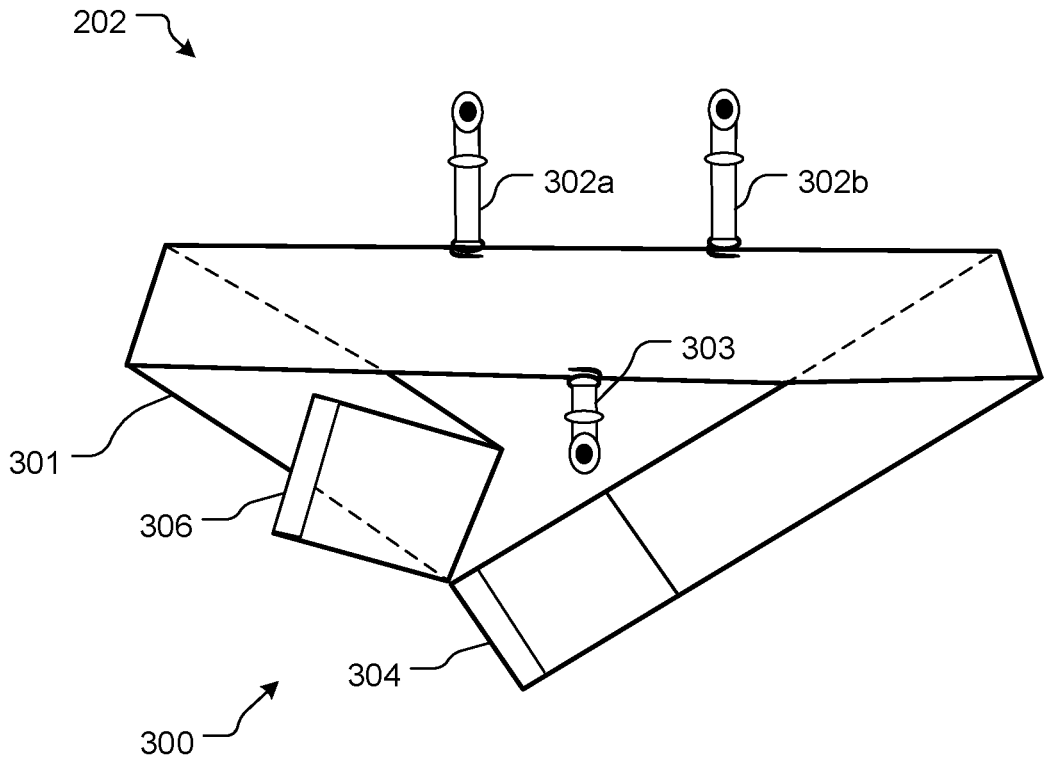
FIG. 3 is a rear view of the undergarment support system from FIG. 2.

In the contemplated embodiment, system 201 includes suspender 202 in communication with the user's bra 203 and lower body clothing (pants, skirt, underwear, etc.) 204. As shown in FIG. 3, the suspender 202 include a belt strap 301 in communication with one or more adjustable top connectors 302*a*, 302*b* and one or more adjustable bottom connectors 303. During use, the belt strap 301 is fastened around the user's waist and secured in position via a locking device 300 having a plurality of loops 304 adapted to engage with a plurality of hooks 306. In the preferred embodiment, the belt strap 301 is selectively adjusted to fit snugly around the mid-section of the user above or around the belly button (not shown).

When used, the top and bottom connectors 302, 303 are connected to the user's bra 203 and lower body garment 204 to relieve pressure along the user's midsection and shoulders provide additional clothing support and structure.

It should be appreciated that one of the unique features believed characteristic of the present application is versatility of system 201 due to the adjustability of the connectors 302*a*, 302*b*, 303 and belt strap 301. It is understood that system 201 can be used in conjunction with most bras and adjusted by the user for comfort.

It is contemplated that the belt strap 301 can be fastened in the front via a hook and loop fastener, hook and eye fasteners, or any other means as well as vary in size and material. In addition, it is contemplated that the connectors 302*a*, 302*b*, 303 can be permanent or removable and can vary in quantity, length, and location along the belt 301. Further, it is contemplated that the connectors 302*a*, 302*b*, 303 can attach to clothing via snaps, hooks, clamps, or any other means.

Figure 4:
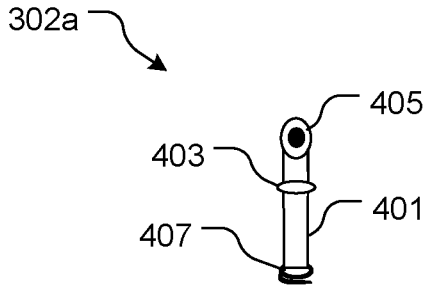
FIG. 4 is a front view of the connector of the system of FIG. 3.

Referring specifically to FIG. 4, a front view of connector 302*a* is shown. It will be appreciated that all connectors discussed herein share one or more of the same features. In the preferred embodiment, the connector 302*a* preferably includes one or more of an elongated strap 401 preferably composed of an elastic material for increase in length during use and having an adjustment device 403, e.g., a buckle, secured thereto for adjusting the overall length of strap 401. At one end of the elongated strap 401 is a fastener 405 configured to removably engage with an article of clothing, e.g., a bra, while at a second end of the elongated strap 401 is a hook 407 and/or similar device configured to removably engage with the belt strap 301 in a more permanent fashion. It will be appreciated that an alternative embodiment could include a plurality of connectors permanently attached to the belt strap in lieu of the preferred embodiment.

Figure 5:
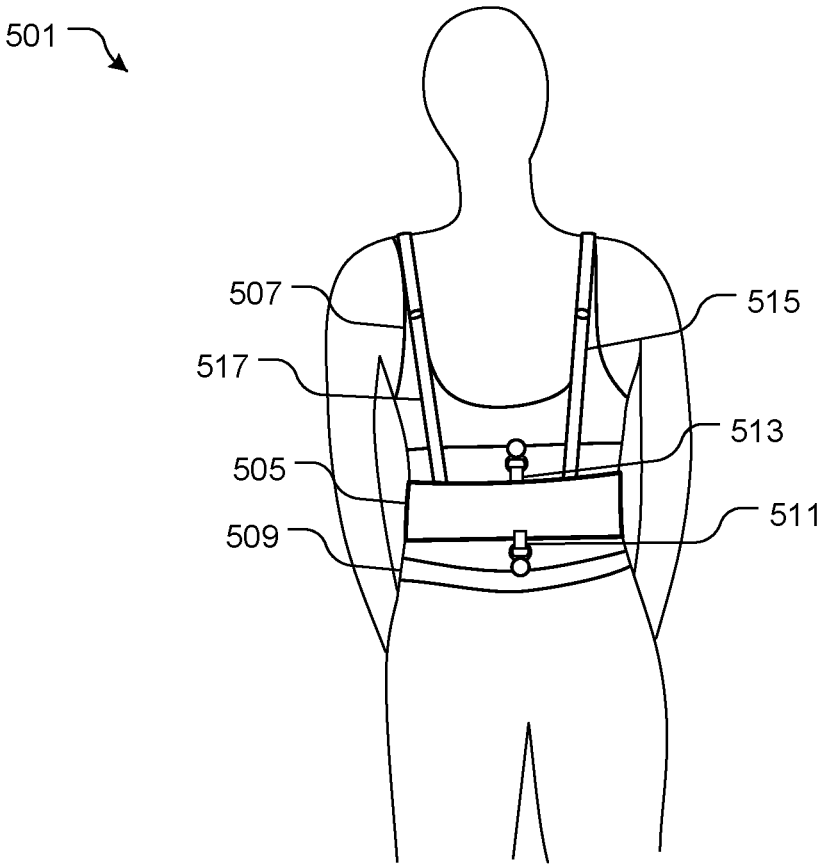
FIG. 5 is a rear view of an undergarment support system in accordance with an alternative embodiment of the present application.

In FIG. 5 a rear view of an alternative embodiment of an undergarment support system 501 in accordance with the present application. System 501 is similar in form and function to system 201 with minor modifications. It should be appreciated that any of the features discussed above can also be incorporated into system 501. System 501 includes a suspender 503 having a belt strap 505 of greater width than the belt described above, the belt strap 505 configured to removably secure around the mid section of the wearer. The suspender 503 is connected to the user's bra 507 and lower garment 509 (underwear, pants, etc.).

Figure 6:
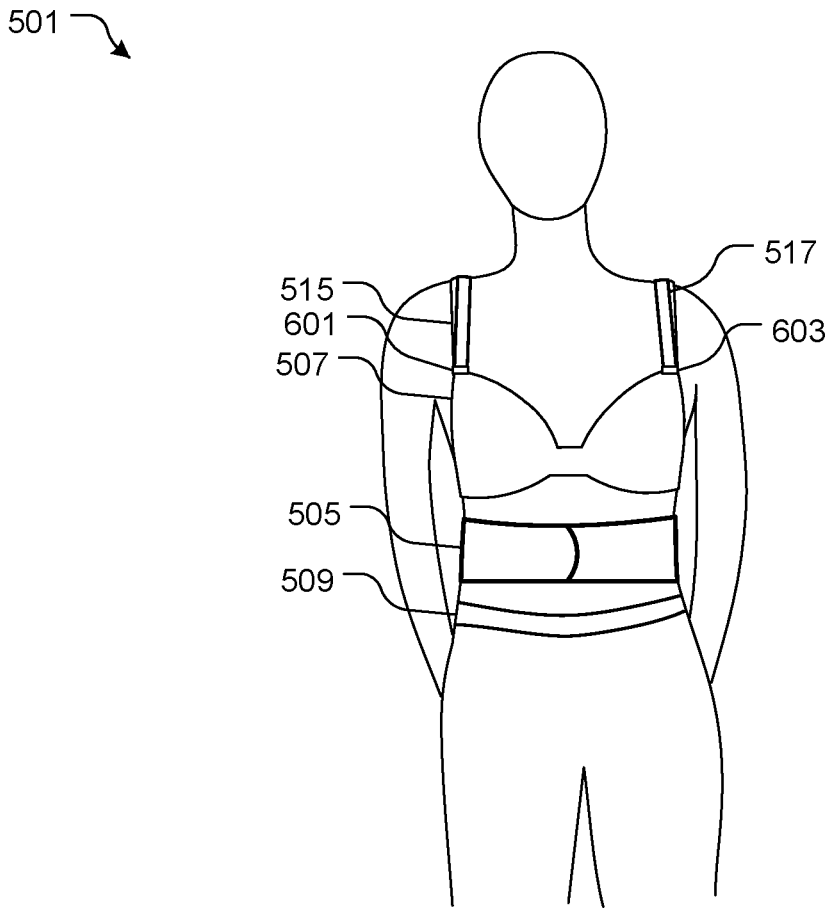
FIG. 6 is a front view of the system of FIG. 5.

In this embodiment, a first connector 511 is attached to the lower edge of the belt strap, the first connector 511 configured to engage with the lower garment. A second connector 513 is positioned along the upper edge of the belt strap and is to engage with the back of the bra. Further included is a first adjustable over the shoulder strap 515 and a second over the shoulder strap 517. As shown in FIG. 6, the over the shoulder straps 515, 517 are configured to engage with a front of the bra via one or more bra connections 601, 603. It should be appreciated that this configuration provides for additional support.

Figure 7:
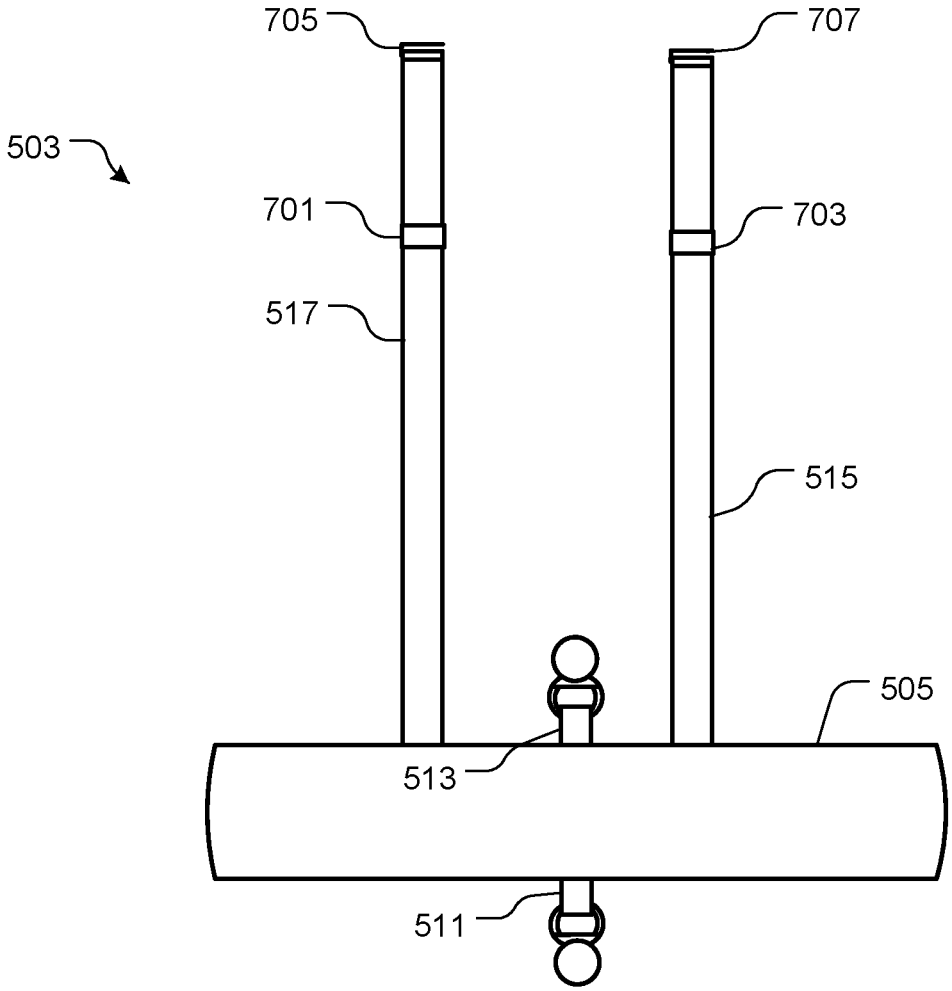
FIG. 7 is a rear view of a suspender of FIG. 5.

In FIG. 7, the suspender 503 is shown in detail. As shown, the over the shoulder straps 515, 517 can include adjustable sliders 701, 703 to adjust the length of the straps as needed by the user. Further, the over the shoulder straps 515, 517 include one or more hooks 705, 707 to engage with the bra connections.

Figure 8:
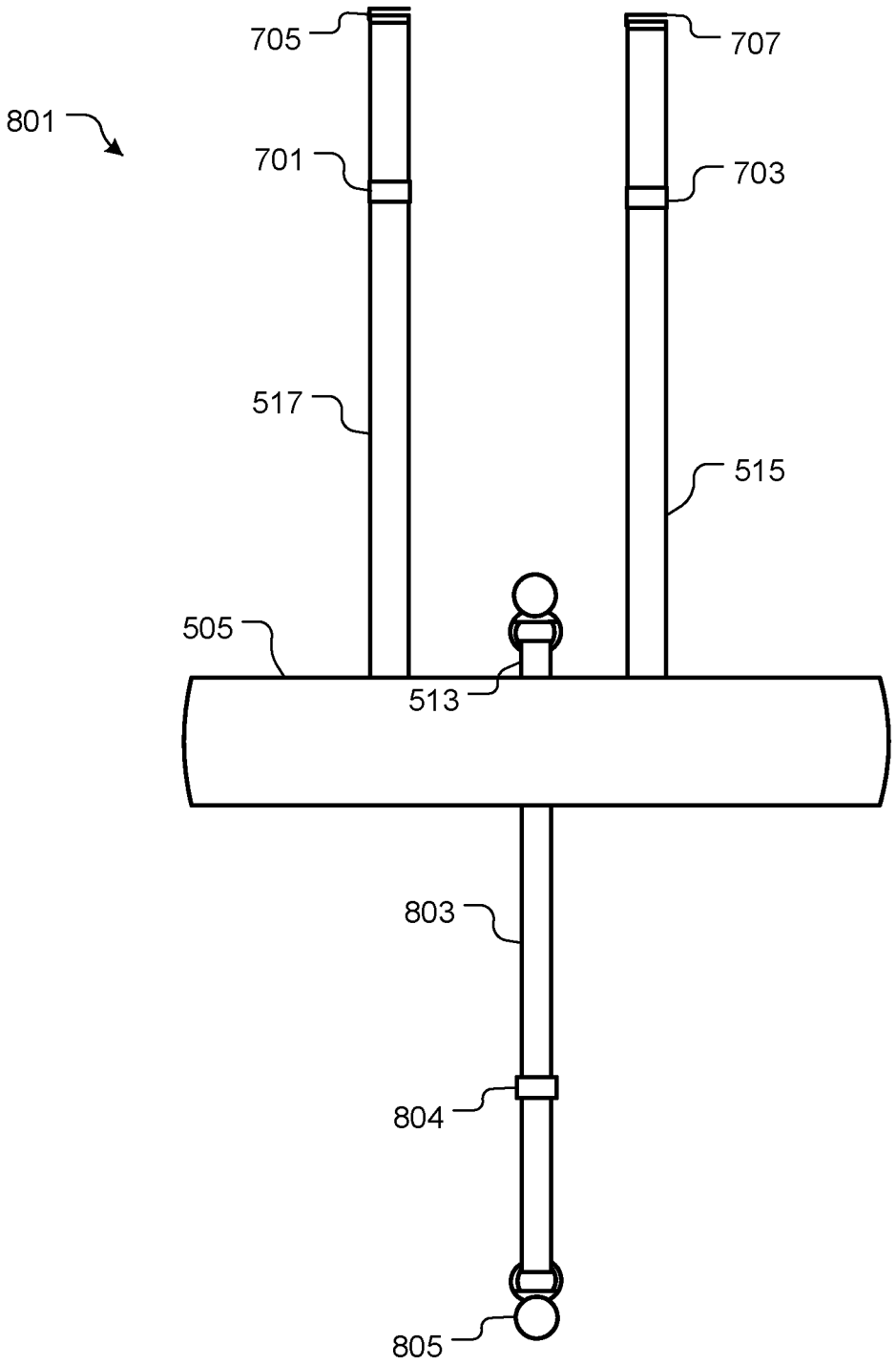
FIG. 8 is a rear view of a suspender in accordance with another alternative embodiment of the present application.

In FIG. 8, an alternative embodiment of a suspender 801 is shown, having most of the features described above, and further including an elongated strap 803 extending from the lower edge of the belt, the elongated strap 803 having an adjustable slider 804 and a connector 805 to engage with a user's lower body garment in the front. It should be appreciated that the strap can be extended underneath and between the user's legs to engage with a front of the undergarment.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A suspender system configured to engage around a midsection of a user, comprising:

a bra;

a lower body garment; and a suspender, having:

an elongated belt strap configured to removably engage around the midsection of the user;

a first connector secured to a top edge of the elongated belt strap and engaged with a back of the bra;

a second connector secured to a bottom edge of the elongated belt strap and engaged with the lower body garment;

a first over the shoulder strap secured to the top edge of the elongated belt strap and engaged with a front of the bra; and a second over the shoulder strap secured to the top edge of the elongated belt strap and engaged with the front of the bra;

wherein the first and second over the shoulder straps are configured to extend from a back of the user to a front of the user; and wherein the elongated belt strap is positioned between the bra and the lower body garment.

2. The system of claim 1, wherein the elongated belt strap is composed of an elastic material.

3. The system of claim 1, further comprising:

a locking device configured to secure a first end of the elongated strap to a second end of the elongated strap.

4. The system of claim 3, wherein the locking device is a hook-loop fastener.

5. The system of claim 1, wherein the first over the shoulder strap further includes a hook configured to releasably engage with the front of the bra and a slider adjuster configured to adjust a length of the over the shoulder strap.

6. A method to secure a bra to a lower body garment, the method comprising:

providing the system of claim 1;

securing the belt strap in a position between the bra and the lower body garment; attaching the first connector to the bra;

attaching the second connector to the lower body garment; and extending the first over the shoulder strap and the second over the shoulder strap to the front of the bra and securing thereto.

* * * * *